US006272967B1

(12) United States Patent
Bender-Zanoni et al.

(10) Patent No.: US 6,272,967 B1
(45) Date of Patent: Aug. 14, 2001

(54) MODULAR AMMUNITION STORAGE AND RETRIEVAL SYSTEM

(75) Inventors: Joseph F. Bender-Zanoni, Ann Arbor, MI (US); David L. Maher, Burlington, VT (US); Sten Hallqvist, Vingåker; Bertil Wall, Kristinehamn, both of (SE)

(73) Assignee: General Dynamics Armament Systems, Inc., Burlinton, VT (US)

( * ) Notice: Subject to any disclaimer, the term of this patent is extended or adjusted under 35 U.S.C. 154(b) by 0 days.

(21) Appl. No.: 09/332,165

(22) Filed: Jun. 14, 1999

(51) Int. Cl.[7] ..... F41A 9/02; F41A 9/09; F41A 9/63

(52) U.S. Cl. ..... 89/33.04; 89/33.16; 89/33.5; 89/46

(58) Field of Search ..... 89/33.04, 33.5, 89/34, 33.14, 33.16, 45, 46

(56) References Cited

U.S. PATENT DOCUMENTS 4,015,511 * 4/1977 Folsom et al. ..... 89/33 SF
4,434,699 * 3/1984 Tassie ..... 89/12
4,765,223 * 8/1988 Beckmann ..... 89/33.04
5,212,338 5/1993 Maher ..... 89/45
5,271,310 * 12/1993 Muller ..... 89/33.04
5,614,689 * 3/1997 Gyre et al. ..... 89/33.04

* cited by examiner

*Primary Examiner*—Michael J. Carone
*Assistant Examiner*—Kyongtack K. Mun
(74) *Attorney, Agent, or Firm*—Finnegan, Henderson, Farabow, Garrett & Dunner, L.L.P.

(57) ABSTRACT

An ammunition storage and retrieval system for a weapon is provided. The storage and retrieval system includes a main magazine having a main carrier belt that is configured to store a plurality of munitions have a first set of handling characteristics and a handoff unit that retrieves a selected one of the plurality of munitions and transfers the selected munition to the weapon. The main magazine also includes an auxiliary magazine mount. There is further provided a set of auxiliary magazines that are selectively engageable with the auxiliary magazine mount. A first one of the auxiliary magazines is configured to store munitions having the first set of handling characteristics and a second one of the auxiliary magazines is configured to store munitions having a second set of handling characteristics.

33 Claims, 6 Drawing Sheets

MODULAR AMMUNITION STORAGE AND RETRIEVAL SYSTEM

BACKGROUND OF THE INVENTION

The present invention relates to an ammunition storage and retrieval system. More particularly, the invention is directed to a modular magazine for storing and retrieving munitions having different handling characteristics.

Ammunition storage and retrieval systems are a necessary part of nearly every large caliber artillery weapon system. The large size of the ammunition used in these weapon systems often prohibits manual loading of the weapon. Thus, ammunition storage and retrieval systems are provided to store a supply of ammunition for the weapon and to transfer ammunition from the storage area to the weapon for firing.

Each storage and retrieval system is specifically designed to meet the needs of the weapon it serves. One consideration in the design of the storage and retrieval system is the number of munitions the storage and retrieval system should store. The number of stored munitions depends on the operating nature of the weapon served by the system. In particular, the number of munitions stored depends on the size of the munitions and the ease with which the munition store may be restocked. Obviously, an ammunition and retrieval system on board a ship would necessarily hold a greater number of munitions than a similar system on a tank, or other ground based weapon, since the ground based system is easier to restock.

Another consideration for the ammunition storage and retrieval systems are the specific handling characteristics of the munitions used by the particular weapon. The handling characteristics of the munitions will impact the manner in which the munitions are stored as well as the manner in which the munitions are transferred to the weapon. The specific handling characteristics of each munition are determined by the shape and weight of the munition. Specifically, the handling characteristics of a munition include the length, outer configuration, and weight of the munition as well as any other external characteristic, such as fins or other guidance device, that is specific to the particular munition. Both the storage area and the transfer mechanism must be designed to account for the handling characteristics of the munitions to prevent the munitions from being damaged in storage or during transfer to the weapon.

As an additional consideration for these storage systems, certain weapons often fire different types of munitions that are specifically designed to meet different situational needs. For example, a ground based artillery system, such as a howitzer, may fire munitions that have different ranges or different explosive charges. To serve these different purposes, the munitions often have different shapes and weights. To be effective, the storage and retrieval system for the weapon must be capable of storing and retrieving each of the differently shaped munitions.

Certain types of munitions, particularly certain extended range munitions, present a unique problem for storage and retrieval systems. These extended range munitions are problematic because their length is substantially greater than the length of a standard range munition. For example, in the case of the howitzer, a standard range munition for a 155 mm caliber howitzer has a length of about one meter where the extended range munitions have lengths of about one and a half meters. To account for the greater length of the munitions, the length of the storage and retrieval systems will also have to be increased.

However, the extended range munitions are expensive and are expected to be used less frequently than the standard range munitions and, for some scenarios, the extended range munitions may not be required. Thus, most weapons will need to be able to carry a mix of standard range and extended range munitions. The mixture will likely include a large number of standard range munitions combined with a smaller number of extended range munitions. Because the size of the storage system must be increased to compensate for a relatively few extended range munitions, the resulting storage and retrieval system will have an increased weight that will include a large amount of empty space.

In light of the foregoing, there is a need for an ammunition storage and retrieval system capable of storing and retrieving munitions having different handling characteristics and capable of re-configuring to adapt to the varying munition needs of different missions.

SUMMARY OF THE INVENTION

The present invention is directed to an ammunition storage and retrieval system that obviates one or more of the limitations and disadvantages of the prior art storage and retrieval systems. The advantages and purposes of the invention will be set forth in part in the description which follows, and in part will be obvious from the description, or may be learned by practice of the invention. The advantages and purposes of the invention will be realized and attained by the elements and combinations particularly pointed out in the appended claims.

To attain the advantages and in accordance with the purposes of the invention, as embodied and broadly described herein, the invention is directed to an ammunition storage and retrieval system for a weapon. The system includes a main magazine that has an auxiliary magazine mount. The main magazine also includes main carrier belt that is configured to store a plurality of munitions having a first set of handling characteristics. A handoff unit is provided to retrieve a selected one of the plurality of munitions and transfer the selected munition to the weapon.

In another aspect, the invention is directed to a modular magazine for a weapon. The modular magazine includes a main magazine that has an auxiliary magazine mount. There is provided an auxiliary magazine that is selectively engageable with the auxiliary magazine mount of the main magazine. The auxiliary magazine includes a supplemental carrier belt configured to store a plurality of munitions having a second set of handling characteristics and a rammer that operates to transfer a selected one of the munitions from the supplemental carrier belt to the weapon.

In still another aspect, the invention is directed to an ammunition storage and retrieval system for a weapon. The system includes a main magazine that has an auxiliary magazine mount and a main carrier belt that is configured to store a plurality of munitions having a first set of handling characteristics. A handoff unit is provided to retrieve a selected one of the plurality of munitions and transfer the selected munition to the weapon. There is provided a first supplemental magazine that is selectively engageable with the auxiliary magazine mount of the main magazine. The first supplemental magazine includes a first supplemental carrier belt configured to store a plurality of munitions that have the first group of handling characteristics. The engagement of the first supplemental magazine with the auxiliary magazine mount positions the first supplemental carrier belt adjacent the handoff unit. The handoff unit transfers a selected munition from the first supplemental carrier belt to the weapon. There is further provided a second supplemental magazine. The second supplemental magazine is interchangeable with the first supplemental magazine and is selectively engageable with the auxiliary magazine mount. The second supplemental magazine has a second carrier belt that is configured to store a plurality of munitions that have a second set of handling characteristics. A rammer transfers a selected one of the plurality of munitions from the second carrier belt to the weapon.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DETAILED DESCRIPTION

Reference will now be made in detail to the presently preferred embodiments of the invention, examples of which are illustrated in the accompanying drawings. Wherever possible, the same reference numbers will be used throughout the drawings to refer to the same or like parts.

In accordance with the present invention, an ammunition storage and retrieval system is provided. The ammunition storage and retrieval system includes a main magazine that is configured to store a plurality of munitions having a first set of handling characteristics. The term munition, as used in this disclosure, is intended to encompass any ammunition or ammunition component readily apparent to one skilled in the art, including, but not limited to, projectiles, propellant charges, and rocket assist devices. An exemplary embodiment of the main magazine of the present invention is illustrated in FIG. 1 and is designated generally by reference number 20.

Figure 1:
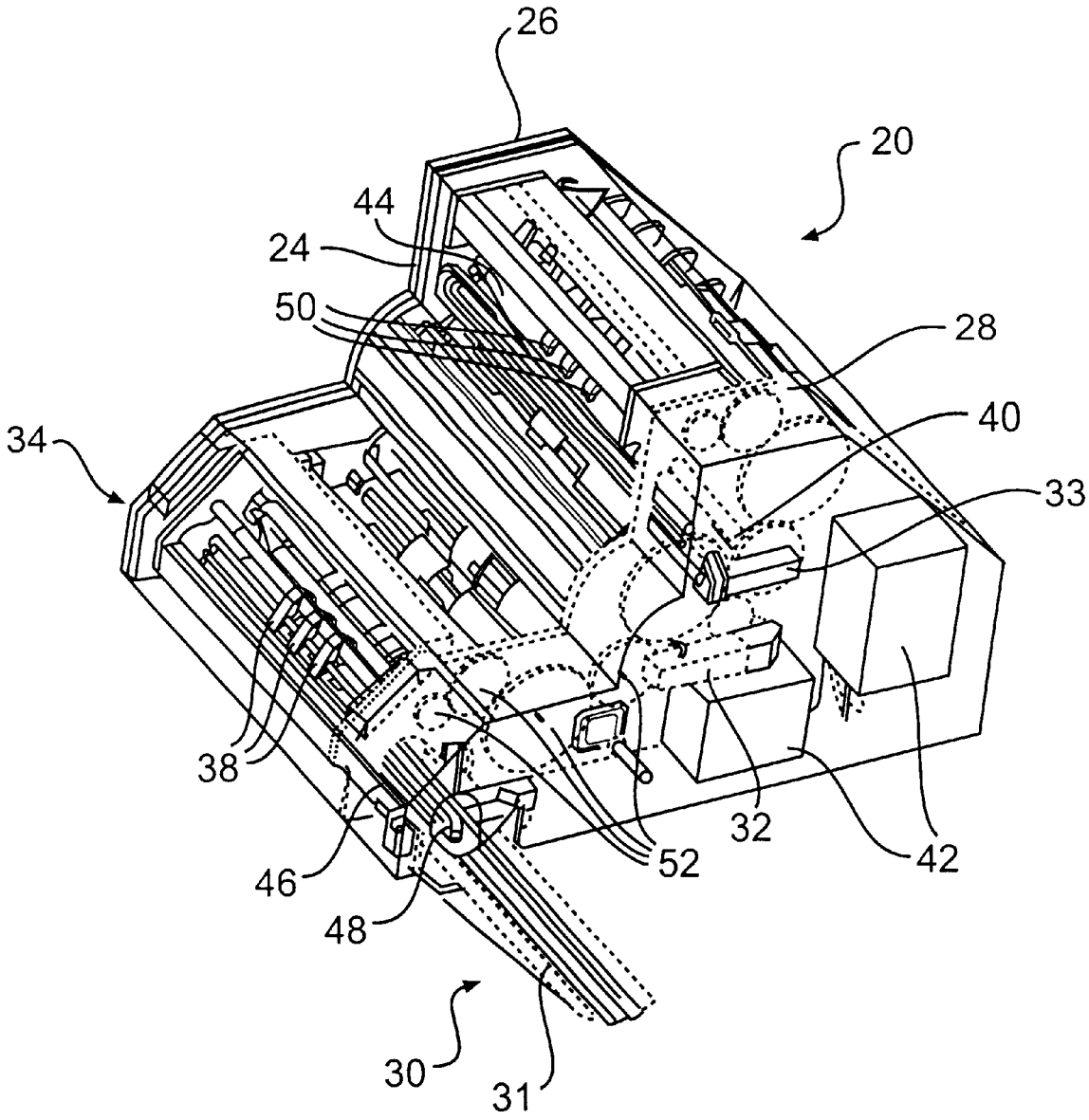
FIG. 1 is a perspective view of a main magazine and an auxiliary magazine mount of the main magazine according to the present invention.

As illustrated in FIG. 1, main magazine 20 includes a pair of support plates 26 and 28. In the exemplary embodiment, support plate 26 defines the front end, or weapon end, of main magazine 20. Support plate 28 defines the rear end, or the loading end, of main magazine 20.

Figure 2:
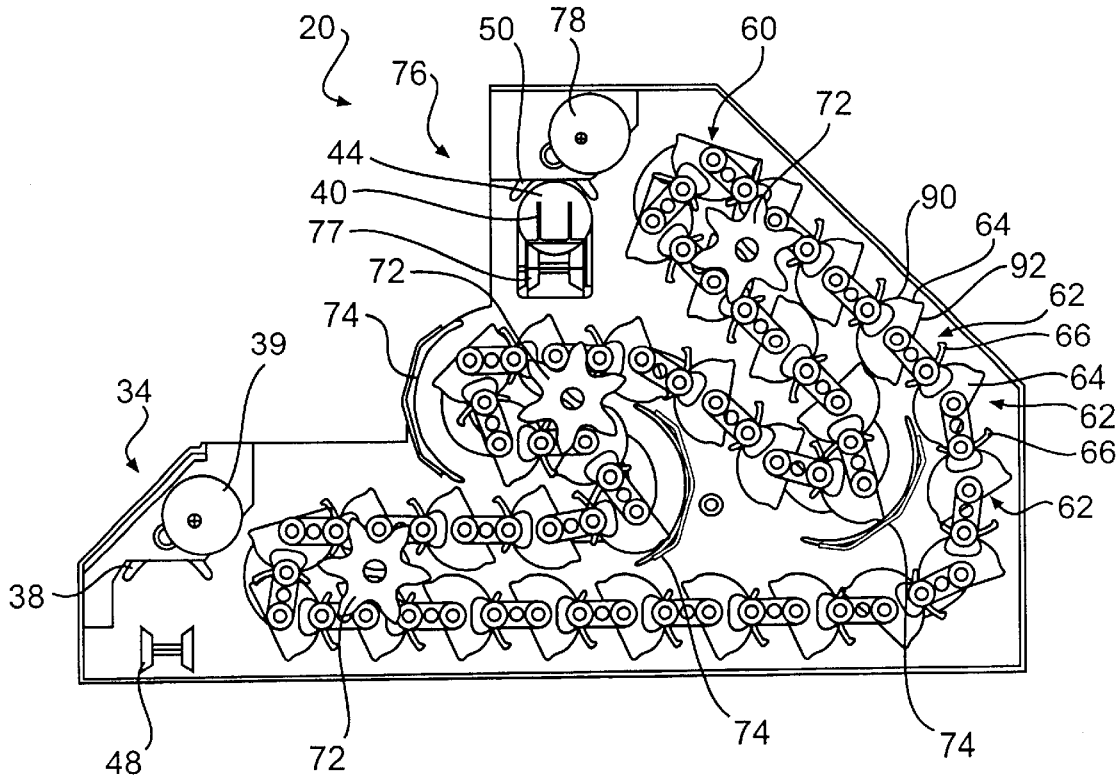
FIG. 2 is an end view of the main magazine of FIG. 1.
Figure 3A:
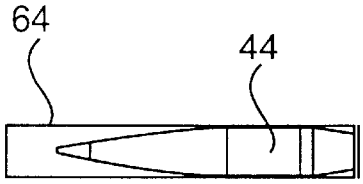
FIGS. 3*a*–3*f* are top views of a cradle in a main carrier belt housing munitions having similar handling characteristics.
Figure 3D:
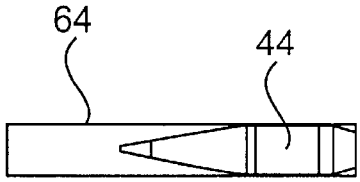
Figure 3B:
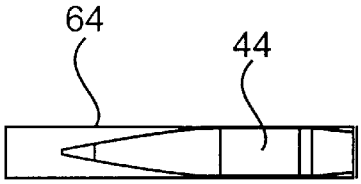
Figure 3E:
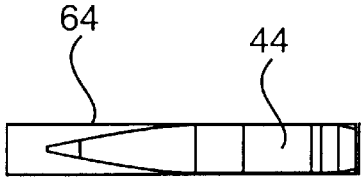
Figure 3C:
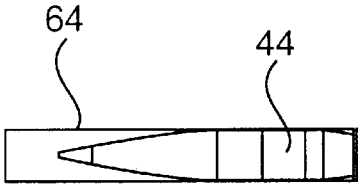
Figure 3F:
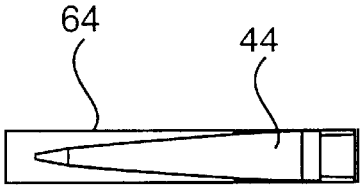

As shown in FIG. 2, main magazine 20 preferably includes a main carrier belt 60 to store the plurality of munitions, although alternative devices for storing munitions will be readily apparent to one skilled in the art. Main carrier belt 60 includes a series of interconnected munition carriers 62. Each munition carrier 62 includes a cradle 64 and a brace 66.

Cradle 64 within each munition carrier 62 has an open end 92 and a rounded end 90. Open end 92 of cradle 64 is configured to receive a single munition 44. One brace 66 is connected to rounded end 90 of each cradle 64 and is thus disposed opposite open end 92 of the adjacent cradle 64. In this manner, each brace 66 locks a munition within the adjacent cradles 64. Thus, main carrier belt 60 includes a plurality of ammunition carriers 62, each of which includes a cradle and a brace configured to store a single munition.

Each cradle 64 in main carrier belt 60 is configured to hold any one of a number of different types of munitions that have similar handling characteristics. The handling characteristics of a munition include, for example, the length, the center of gravity location, rotating band location, obturator location, outer configuration, and weight of the munition as well as any other external characteristic, such as fins or other guidance device, that is specific to the particular munition. The different handling characteristics of the munitions may be a result of the munitions having different purposes. For example, different munitions used by the weapon may contain different explosive charges or have different flight characteristics. Because the munitions are designed differently, they may have different lengths, outer configurations, or weights. For simplicity purposes in this disclosure, however, the munitions will be grouped into two basic categories of handling characteristics based on the relative lengths of the munition: standard range munitions that have a relatively shorter length and extended range munitions that have a relatively longer length. It is contemplated that the munitions may be grouped by any other handling characteristic.

As illustrated in FIGS. 3*a*–3*f*, cradles 64 are configured to hold a variety of standard range munitions 44 having different handling configurations. However, the handling characteristics of the illustrated munitions 44 are similar enough that cradle 64 is capable of storing each of the munitions. It should be noted that the handling characteristics of munitions will likely evolve as improved munitions are developed. It is contemplated that the munition carriers of the present invention may be equipped with additional features to account for the new handling characteristics.

Figure 4:
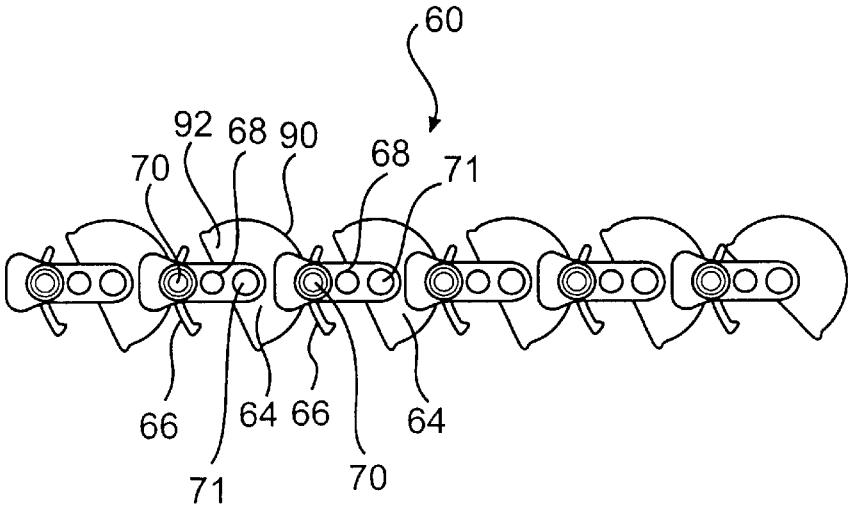
FIG. 4 is a side view of a portion of a main carrier belt according to the present invention.

As illustrated in FIG. 4, cradles 64 are interconnected by links 68. Links 68 are connected to cradles 64 with a fixed connection 70 and a rotatable connection 71. In the illustrated embodiment, the interconnection of munition carriers 62 forms a serpentine pattern within main magazine 20. Preferably, the serpentine pattern is configured to maximize the number of munition carriers 62 and, thus, maximize the number of munitions that may be stored in main magazine 20. In the exemplary embodiment, main magazine 20 stores thirty-two munitions.

As shown in FIG. 2, a set of guides 74 are mounted within the main magazine 20 along the curves in the serpentine pattern. As illustrated, at certain points in the serpentine pattern of the main carrier belt, braces 66 rotate away from the corresponding cradle 64. Guides 74 are positioned along the serpentine path to ensure that the munitions remain within cradles 64 when the serpentine pattern of main carrier belt 60 causes braces 66 to move out of contact with the munitions.

A set of sprockets 72 are rotatably disposed within main magazine 20. Sprockets 72 engage main carrier belt 60 at connection points 70 and 71 between links 68 and cradles 64. The rotation of sprockets 72 causes main carrier belt 60 to move within the main magazine. Rotatable connections 71 allow munition carriers 62 to rotate relative to one another to follow the serpentine path created by sprockets 72 and guides 74.

As shown in FIG. 1, main magazine 20 also includes a main motor 32. Main motor 32 engages and drives a series of gears 52. The operation of main motor 32 turns gears 52, which are connected to sprockets 72. Thus, the operation of main motor 32 causes sprockets 72 to rotate, which causes main carrier belt 60 to traverse through its defined course within main magazine 20.

As shown in FIGS. 1 and 2, main magazine 20 also includes an upper handoff unit 76 and a lower handoff unit 30. A handoff unit suitable for use with the present invention is disclosed in U.S. Pat. No. 5,212,338, which is hereby incorporated by reference in its entirety. U.S. Pat. No. 5,212,338 discloses the overall structure and operation of the handoff unit and its disclosure of the basic structural components and operation will not be repeated.

The disclosed handoff unit is known in the art as a side-stripping handoff unit because the munitions are removed from the carrier belt from the side. The present invention contemplates that other handoff units readily apparent to one skilled in the art are within the scope of this invention. Other handoff units may include, for example, end-stripping handoff units where the munitions are retrieved through one end of the carrier belt.

As illustrated in FIGS. 1 and 2, the upper handoff unit 76 includes a transfer fork 50. Handoff unit 76 is positioned adjacent main carrier belt 60 at a curve in the serpentine pattern where the brace on the adjacent munition carrier has rotated away from cradle 64. Transfer fork 50 is connected to an eccentric cam 78. The rotation of eccentric cam 78 engages transfer fork 50 with the munition in the adjacent munition carrier. Additional rotation of eccentric cam 78 moves the munition 44 from the munition carrier to a conveyor 77. The handoff device includes a clutch (not shown) to allow selective activation and subsequent motion of the transfer fork.

As shown in FIGS. 1 and 2, a push-out device 40 is positioned behind conveyor 48. As shown and known in the art, push-out device 40 has a U-shaped piece that engages munition 44. The U-shaped piece is connected to a chain or a set of chains that are driven by a motor 33. The operation of motor 33 moves the chain or chains to advance the U-shaped piece towards the weapon side of main magazine 20. This motion causes munition 44 to also advance to the weapon side of main magazine 20 and ultimately transfer to the weapon.

In certain situations, the weapon may need to be unloaded. In this case, the weapon will transfer the munition back to conveyor 77 of handoff device 76. Conveyor 77 is operable to move the munition back into the upper handoff unit. Conveyor 77 moves the munition to the rearward position, adjacent the U-shaped piece. Transfer fork 50 then transfers munition 44 back to an empty munition carrier.

As illustrated in FIG. 1, the main magazine 20 also includes a loading mechanism 30. Loading mechanism 30 includes an upload tray 31, a conveyor 48, and a lower handoff unit 34. Upload tray 31 extends from main magazine 20 and is configured to receive a munition 44. Conveyor 48 is positioned adjacent upload tray 31 and is mounted within an opening 46 in support plate 28. Munition 44 may be placed on upload tray 31 and conveyed by conveyor 48 to lower handoff unit 34.

The lower handoff unit 34 includes a transfer fork 38 mounted on an eccentric cam 39. When the munition is in place on conveyor 48, eccentric cam 39 may be rotated to engage the munition and move the munition into a waiting projectile carrier 62. In this manner, munitions may be loaded, one by one, into the main carrier belt 60. A clutch is also provided with the lower handoff unit to allow selective operation of the lower handoff unit.

Preferably, a control system 42 is provided with main magazine 20 to govern the operations of the main magazine, including the uploading of munitions and the transfer of munitions to the weapon for firing. In the preferred embodiment, the control system is operably connected to main motor 32, push-out motor 33, the clutches of upper and lower handoff units 76 and 30, and conveyors 48 and 77. In addition, the control system includes an input device which operates in conjunction with the loading mechanism. As each projectile is loaded, the type of projectile is input to the control system so that the control system can identify the type of munition stored in each munition carrier 62 as well as the total number of munitions stored in main magazine 20. The control system may also maintain any other information considered relevant to the operation of the magazine to one skilled in the art. As each munition is loaded, the control system operates main motor 32 to rotate main carrier belt 60 to position an empty munition carrier adjacent lower handoff unit 30. The control system then engages the clutch of the lower handoff unit to transfer the munition to the empty munition carrier.

Similarly, the control system governs the transfer of the munitions to the weapon. When the type of munition desired to be fired is received by the control system, the control system operates main motor 32 to move main carrier belt 60 within main magazine 20. Each munition carrier 62 moves successively past upper handoff unit 76 until the munition carrier carrying the appropriate munition type is positioned adjacent the upper handoff unit 76. The control system then engages the clutch of the upper handoff unit, thereby causing transfer fork 50 to rotate to engage the munition and move the munition from the munition carrier 62 to conveyor 77. The control device then activates push-out device 40 to transfer the munition to the weapon.

In accordance with the present invention, the main magazine includes an auxiliary magazine mount. A set of auxiliary magazines are provided to selectively engage the auxiliary magazine mount. Each of the set of auxiliary magazine includes a supplemental carrier belt that is configured to store a plurality of munitions having similar handling characteristics.

Figure 5:
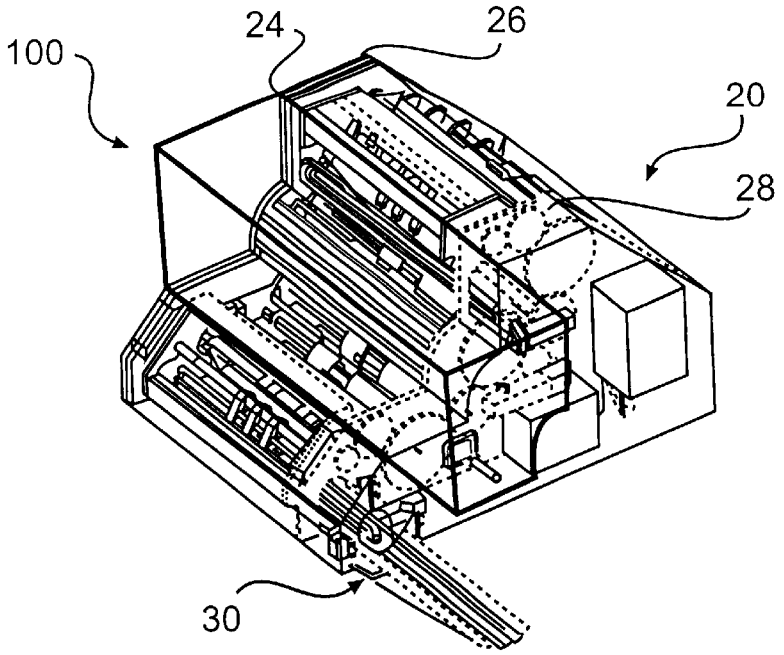
FIG. 5 is a perspective view of an auxiliary magazine engaged with the auxiliary magazine mount of the main magazine.

As shown in FIG. 1, main magazine 20 includes an auxiliary magazine mount 24. The shape of auxiliary magazine mount 24 is defined by support plates 26, 28. As illustrated in FIG. 5, an auxiliary magazine 100 is selectively engageable with auxiliary magazine mount 24. Main magazine 20 and auxiliary magazine 100 include mounting features to facilitate the engagement of the auxiliary magazine with the main magazine. These engagement features may include, for example, bolts, pins, latches, or any other engagement device readily apparent to one skilled in the art.

Figure 6:
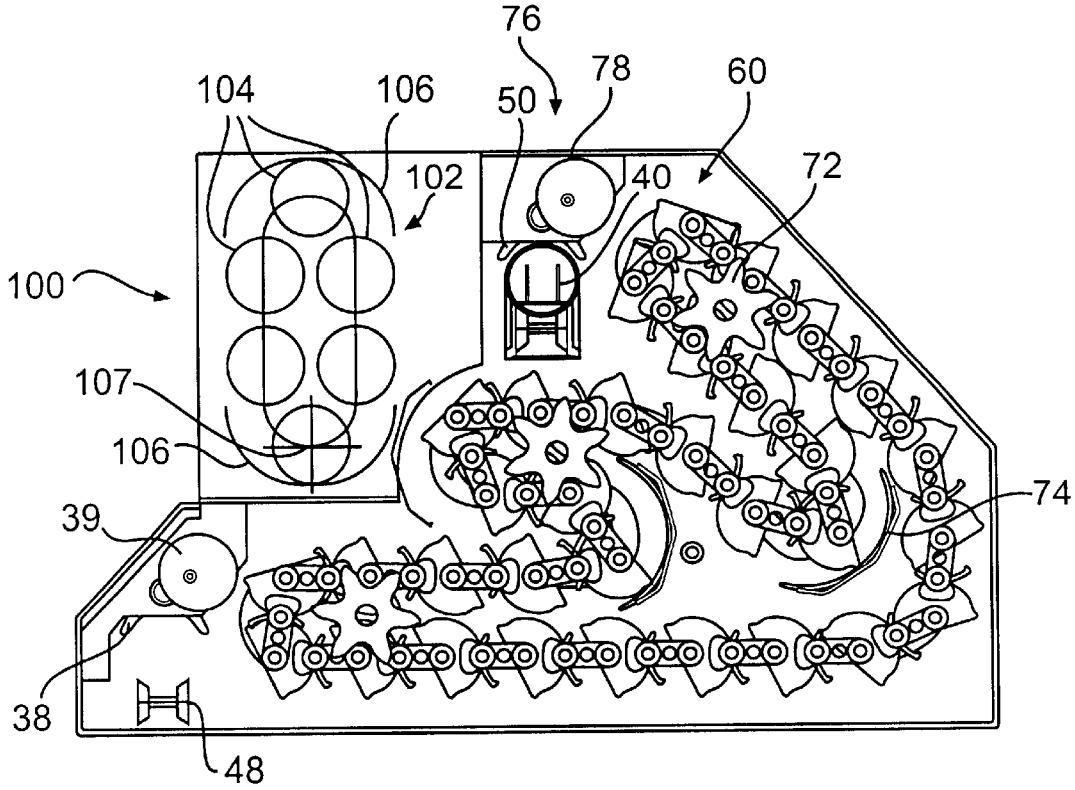
FIG. 6 is an end view of the auxiliary magazine of FIG. 5 engaged with the auxiliary magazine mount of the main magazine.

As shown in FIG. 6, auxiliary magazine 100 includes a supplemental carrier belt 102. Supplemental carrier belt 102 has a plurality of interconnected munition carriers 104 configured to store a plurality of extended range munitions having similar handling characteristics. Munition carriers 104 of supplemental carrier belt 102 are different from the munition carriers of the main carrier belt in that they are designed for end stripping. Munition carriers 104 are interconnected within auxiliary magazine 100 to form a loop. Motor driven sprockets (not shown) are mounted in the auxiliary magazine 100 to move the supplemental carrier belt. Guides 106 are also positioned within auxiliary magazine 100 to ensure munitions remain within supplemental carrier belt 102.

Auxiliary magazine 100 also includes a loading device to move munitions into the munition carriers 104. Preferably, the munitions are inserted into the auxiliary magazine in an endwise manner, although other alternatives will be readily apparent to one skilled in the art.

Figure 7A:
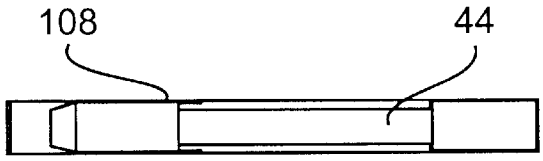
FIGS. 7*a* and 7*b* are top views of extended range munitions in munition carriers of the auxiliary magazine of FIGS. 5 and 6.
Figure 7B:
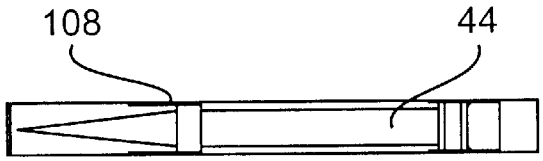

The auxiliary magazine illustrated in FIGS. 5 and 6 has a length greater than the length of main magazine 20. Because of the greater length, the munition carriers of auxiliary magazine 100 may be configured to store extended range munitions that have a length greater than the standard range munitions stored in main magazine 20. As illustrated in FIGS. 7*a* and 7*b*, extended range munitions 44 may also have different outer configurations. However, the handling characteristics are similar enough that cradles 108 may store each shape of munitions 44.

The greater length of the munitions stored in auxiliary magazine 100 creates a problem in that the upper handoff unit 76 of main magazine is incapable of handling the longer munitions. Accordingly, a second transfer mechanism is included in the auxiliary magazine. The second transfer device is positioned along axis 107 as shown in FIG. 6. The second transfer device is preferably a rammer as is known in the art, such as a stiff back chain, thin foil boom, or ribbon rammer that can transfer the munition directly and completely into the gun.

Preferably, the control device of the main magazine further operates to control the operation of the auxiliary magazine. The control device monitors the movement of the supplemental carrier belt to position a munition carrier along the second transfer device. When a munition from the auxiliary magazine is required, the control device operates the second transfer device to transfer the selected munition to the weapon. In this manner, munitions of different configurations may be transferred to the weapon in any order.

Figure 8:
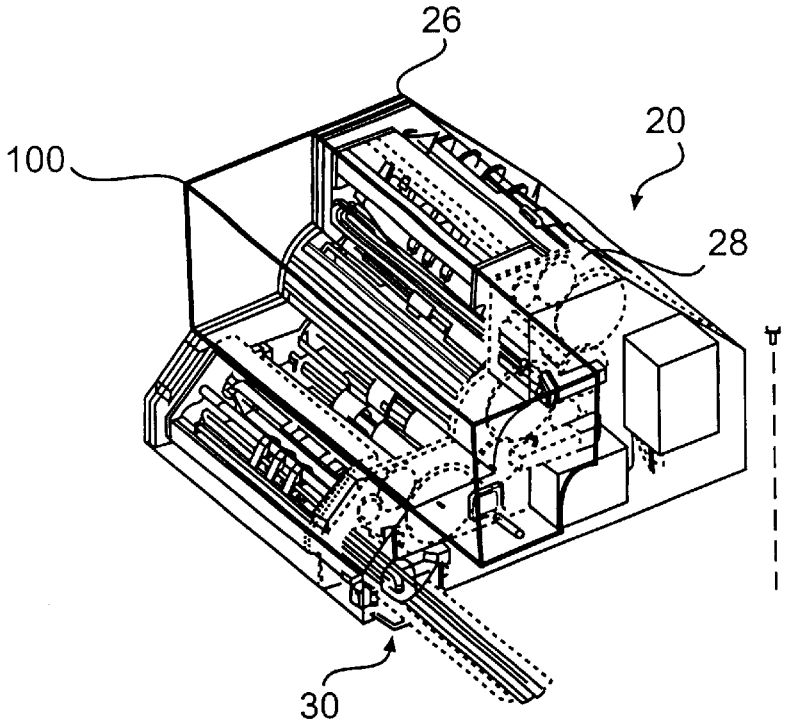
FIG. 8 is a perspective view of another embodiment of an auxiliary magazine engaged with the auxiliary magazine mount of the main magazine.
Figure 9:
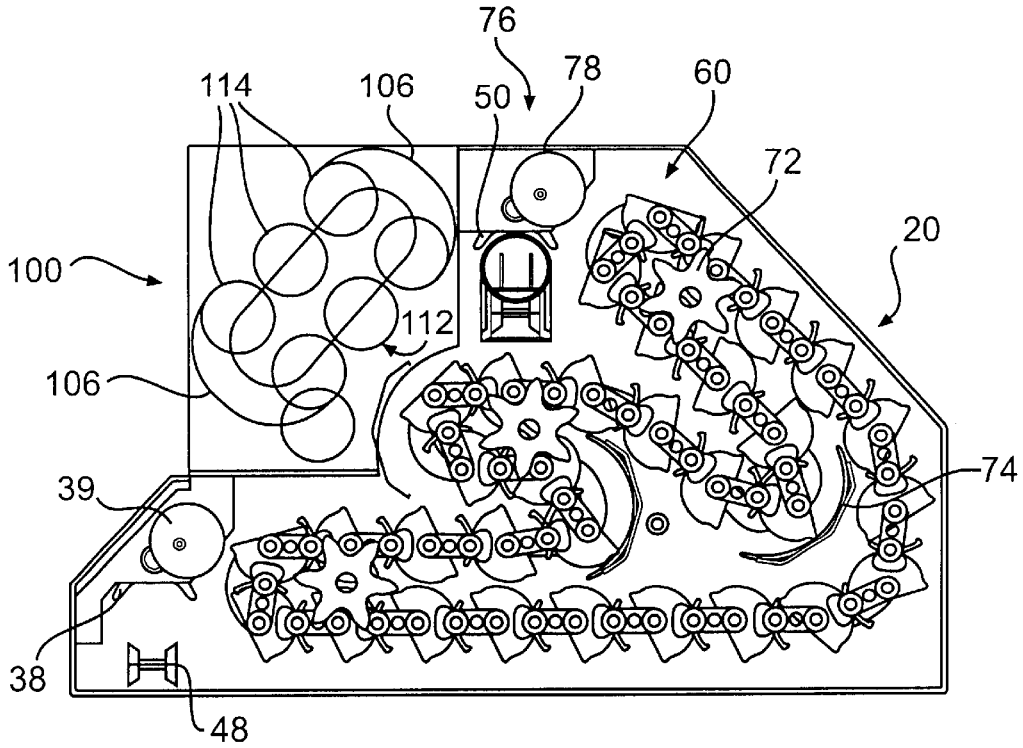
FIG. 9 is an end view of the auxiliary magazine of FIG. 8 engaged with the auxiliary magazine mount of the main magazine.

Another embodiment of the auxiliary magazine of the present invention is illustrated in FIGS. 8 and 9. In this embodiment, auxiliary magazine 100 has a length substantially the same as the length of main magazine 20. Accordingly, auxiliary magazine 100 includes a supplemental carrier belt 112 configured to store a plurality of standard range munitions having handling characteristics similar to those munitions stored in the main magazine.

As shown in FIG. 9, supplemental carrier belt 114 includes a series of interconnected munition carriers 114. Munition carriers 114 are connected in a loop that is positioned such that movement of supplemental carrier belt 114 causes each munition carrier 114 to move successively past upper handoff unit 76 of main magazine 20. Upper handoff unit 76 is operable to retrieve a munition from supplemental carrier belt 114 and transfer the munition to the weapon in a manner similar to that described above for the main carrier belt 60. In addition, upper handoff unit 76 may transfer the selected munition from the supplemental carrier belt 114 to the main carrier belt 60. Similarly, upper handoff unit 76 may retrieve a munition from the main carrier belt 60 and transfer the munition to the supplemental carrier belt 114.

Figure 10:
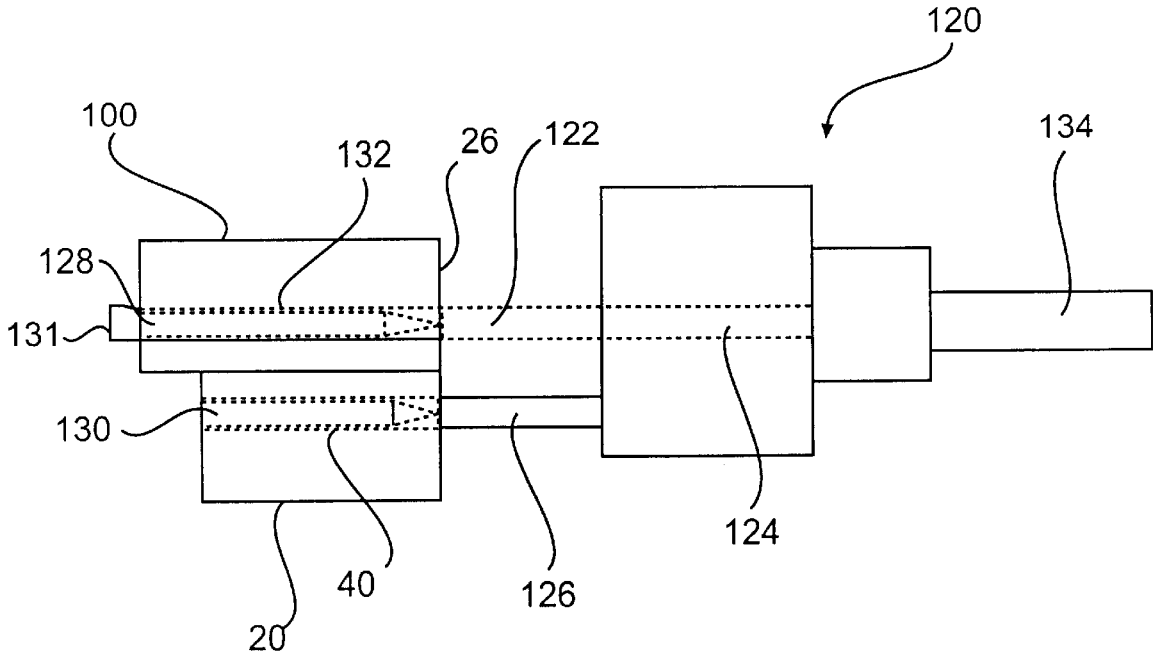
FIG. 10 is a top sectional view of an ammunition storage and retrieval system according to the present invention positioned for use with a howitzer.

The ammunition storage and retrieval system of the present invention will now be described in relation to an artillery weapon system. As illustrated in FIG. 10, the storage and retrieval system of the present invention may be used in conjunction with a howitzer 120. The present invention contemplates, however, that the system disclosed herein may be used with any large caliber artillery weapon systems readily apparent to one skilled in the art, including, but not limited to, weapon systems on board tanks, wheeled vehicles, naval vessels, and resupply vehicles.

As shown in FIG. 10, main magazine 20 and auxiliary magazine 100 are fixed in a loading position behind howitzer 120. Main magazine 20 contains standard range munitions 130 and auxiliary magazine 100 contains extended range munitions 128. Howitzer 120 includes a load arm 126 and a breech 124.

When howitzer 120 requires an extended range munition, the control system of the ammunition and retrieval system operates the auxiliary motor on auxiliary magazine to position a munition carrier 132 along the second transfer mechanism 131 (referring to FIG. 10). The control system then activates the second transfer mechanism to transfer extended range munition 128 to breech 124 of howitzer 120. It may be necessary to provide a means of bridging the gap between the auxiliary magazine and the breech of the weapon as indicated by reference number 122. In addition, depending on the configuration of howitzer 120, it may be necessary to lower the elevation of gun barrel 134 to 0°, or any other angle required to achieve the proper alignment, to load extended range projectile 128 into breech 124. Howitzer 120 is then ready to fire the extended range munition.

When howitzer 120 requires a standard range munition 130, the control system operates main carrier belt 60 of main magazine 20 to position the munition carrier 62 containing a standard range munition 130 adjacent upper handoff unit 76. The control system then activates upper handoff unit 76 to transfer munition 130 to push-out device 40. Push out device 40 is then operated to transfer munition 130 to load arm 126. As is known in the art, load arm 126 is mounted on a pendulum-like structure and is operable to swing munition 130 into alignment with breech 124. Munition 130 is then transferred to breech 124 and howitzer 120 is ready to fire the standard range munition.

As illustrated in FIGS. 8 and 9, in the situation where howitzer 20 will require only standard range munitions, the auxiliary magazine storing the extended range munitions may be interchanged with an auxiliary magazine storing standard range munitions. When this auxiliary magazine is engaged with the auxiliary magazine mount of the main magazine and the howitzer requires a munition from the auxiliary magazine, the control system operates the supplemental carrier belt to position a munition carrier 114 adjacent upper handoff unit 76. The control system then activates the upper handoff unit 76 to transfer the munition from the munition carrier to the push out device 40. The push out device is then activated to transfer the munition to load arm 126 of howitzer 120.

Thus, the disclosed ammunition and storage retrieval system provides a system capable of efficiently handling munitions having different handling characteristics. The main magazine provides a storage area for one group of munitions and the auxiliary magazine mount of the main magazine allows an auxiliary magazine containing a second group of munitions to be mounted on the main magazine. The munitions stored in the auxiliary magazine may have handling characteristics similar to the munitions stored in the main magazine or they may have different handling characteristics. The control system of the main magazine allows the munitions stored in either the main magazine or the auxiliary magazine to be transferred to the weapon in any desired order.

It will be apparent to those skilled in the art that various modifications and variations can be made in the construction of this ammunition storage and retrieval system without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An ammunition storage and retrieval system for a weapon, comprising a main magazine having an auxiliary magazine mount, a main carrier belt configured to store a plurality of munitions having a first set of handling characteristics and a handoff unit operable to retrieve a selected one of the plurality of munitions and transfer the selected munition to the weapon; and a set of interchangeable auxiliary magazines, each of the set of auxiliary magazines selectively engageable with the auxiliary magazine mount of the main magazine.

2. The system of claim 1, wherein each auxiliary magazine in the set of interchangeable auxiliary magazines is configured to store a plurality of munitions having different handling characteristics.

3. The system of claim 2, wherein the handoff unit includes a push-out device operable to push said selected munition from the handoff unit to the weapon.

4. The system of claim 2, wherein the munitions are projectiles.

5. The system of claim 2, wherein the main carrier belt includes a plurality of interconnected munition carriers, each of said munition carriers including a cradle configured to receive one of the plurality of munitions having the first set of handling characteristics and a brace disposed opposite the cradle to retain said munition within the cradle as the main carrier belt moves.

6. The system of claim 5, wherein movement of the main carrier belt causes each of said interconnected munition carriers to move successively past the handoff unit.

7. The system of claim 1, wherein a first auxiliary magazine in the set of auxiliary magazines includes a first supplemental carrier belt configured to store a plurality of munitions having the first set of handling characteristics.

8. The system of claim 7, wherein the engagement of the first auxiliary magazine with the auxiliary magazine mount positions the first supplemental carrier belt adjacent the handoff unit to allow the handoff unit to retrieve a selected one of the plurality of munitions from the first supplemental carrier belt and transfer the selected munition to the weapon, the handoff unit further operable to transfer a selected one of the plurality of munitions from the main carrier belt to the first supplemental carrier belt and to transfer a selected one of the plurality of munitions from the first supplemental carrier belt to the main carrier belt.

9. The system of claim 7, wherein the first supplemental carrier belt includes a plurality of interconnected munition carriers, each of said munition carriers including a cradle configured to receive one of said plurality of munitions having the first set of handling characteristics and a brace disposed opposite the cradle to retain said munition within the cradle as the first carrier belt moves.

10. The system of claim 9, wherein movement of the first supplemental carrier belt causes each of said interconnected munition carriers to move successively past the handoff unit.

11. The system of claim 1, wherein a second auxiliary magazine in the set of auxiliary magazines has a second supplemental carrier belt configured to store a plurality of munitions having a second set of handling characteristics and a rammer operable to transfer a selected one of the plurality of munitions from the second supplemental carrier belt to the weapon.

12. The system of claim 11, wherein the second auxiliary magazine includes a loading device to endwise insert a projectile into a selected one of the plurality of munition carriers in the second auxiliary magazine.

13. The system of claim 11, wherein the second supplemental carrier belt of the second auxiliary magazine includes a plurality of interconnected munition carriers configured to receive one of said plurality of munitions having the second set of handling characteristics, the rammer operable to end strip the one of said plurality of munitions from said munition carrier.

14. The system of claim 13, wherein movement of the second supplemental carrier belt of the second auxiliary magazine causes each of said interconnected munition carriers to move successively past the rammer.

15. The system of claim 11, wherein the first and second sets of handling characteristics include the relative lengths of the munitions and the munitions having the second set of handling characteristics are longer than the munitions having the first set of handling characteristics.

16. The system of claim 15, wherein the weapon includes a load arm and a breech, the handoff unit operable to transfer the munition selected from the main carrier belt to the load arm for subsequent transfer to the breech and the rammer operable to transfer the munition selected from the second supplemental carrier belt to the breech.

17. The system of claim 16, wherein the weapon is a howitzer and the plurality of munitions having the second set of handling characteristics are extended range projectiles.

18. A modular magazine for a weapon, comprising:

a main magazine having an auxiliary magazine mount, a main carrier belt configured to store a plurality of munitions having a first set of handling characteristics, and a handoff unit operable to retrieve a selected munition from the main carrier belt and transfer the selected munition to the weapon; and an auxiliary magazine selectively engageable with said auxiliary magazine mount and having a supplemental carrier belt configured to store a plurality of munitions having a second set of handling characteristics and a rammer operable to transfer a selected munition from the supplemental carrier belt to the weapon.

19. The magazine of claim 18, wherein the weapon includes a load arm and a breech and the handoff unit transfers the selected munition from the main carrier belt to the load arm of the weapon for subsequent transfer to the breech and the rammer transfers the selected munition from the supplemental carrier belt to the breech of the weapon.

20. The magazine of claim 18, wherein the main carrier belt includes a plurality cf interconnected munition carriers having a cradle configured to receive one of the munitions having the first set of handling characteristics and a brace disposed opposite the cradle to retain said munition within the cradle.

21. The magazine of claim 18 wherein the supplemental carrier belt includes a plurality of interconnected munition carriers configured to receive one of the munitions the second set of handling characteristics.

22. The magazine of claim 18, further comprising a main motor operably connected to the main carrier belt to drive the main carrier belt, an auxiliary motor operably connected to the supplemental carrier belt to drive the supplemental carrier belt, and a control system operable to independently control the main motor and the auxiliary motor.

23. The magazine of claim 18, wherein the first and second sets of handling characteristics include the relative lengths of the munitions and the plurality of munitions having the second set of handling characteristics are longer than the plurality of munitions having the first set of handling characteristics.

24. The magazine of claim 23, wherein the plurality of munitions having the second set of handling characteristics are extended range projectiles.

25. An ammunition storage and retrieval system for a weapon, comprising:

a main magazine having an auxiliary magazine mount, a main carrier belt configured to store a plurality of munitions having a first set of handling characteristics, and a handoff unit operable to transfer a selected munition from the main carrier belt to the weapon;

a first supplemental magazine selectively engageable with said auxiliary magazine-mount and having a first carrier belt configured to store a plurality of munitions having the first set of handling characteristics, wherein the engagement of the first supplemental magazine with said auxiliary magazine mount positions the first carrier belt adjacent said handoff unit, the handoff unit operable to transfer a selected munition from the first carrier belt to the weapon; and a second supplemental magazine interchangeable with the first supplemental magazine to selectively engage said auxiliary magazine mount and having a second carrier belt configured to store a plurality of extended range munitions having a second set of handling characteristics and a rammer operable to transfer a selected munition from the second carrier belt to the breech of the weapon.

26. The system of claim 25, further comprising a control system operable to individually control the movement of each of the main carrier belt, the first carrier belt, and the second carrier belt.

27. The system of claim 26, further comprising a main motor operably connected to the main carrier belt to drive the main carrier belt, a first motor operably connected to the first carrier belt to drive the first carrier belt, and a second motor operably connected to the second carrier belt to drive the second carrier belt, wherein the operation of the main motor, the operation of the first motor, and the operation of the second motor is independently controlled by the control system.

28. The system of claim 25, wherein the weapon includes a load arm and a breech and the handoff unit transfers said selected munition from the main carrier belt to the load arm of the weapon for subsequent transfer to the breech and the rammer transfers said selected munition from the second carrier belt to the breech of the weapon.

29. The system of claim 28, wherein the handoff unit includes a push-out device operable to push said selected munition to the load arm of the weapon.

30. The system of claim 29, wherein the weapon is a howitzer.

31. The system of claim 25, further comprising an upload unit to load munitions into the main magazine, the upload unit including a conveyor and a second handoff unit operable to move a munition from the upload conveyor into a selected carrier in the main carrier belt.

32. The system of claim 31, wherein the first supplemental magazine includes a first loading device to endwise insert a selected one of the plurality of munitions into the first supplemental carrier belt and the second supplemental magazine includes a second loading device to endwise insert a selected one of the plurality of extended range munitions into the second supplemental carrier belt.

33. The system of claim 32, further comprising a control system to identify the type of munition loaded and the selected carrier.

* * * * *

UNITED STATES PATENT AND TRADEMARK OFFICE

CERTIFICATE OF CORRECTION

PATENT NO. : 6,272,967 B1
APPLICATION NO. : 09/332165
DATED : August 14, 2001
INVENTOR(S) : Joseph F. Bender-Zanoni et al.

It is certified that error appears in the above-identified patent and that said Letters Patent is hereby corrected as shown below:

Claim 1, col. 9, line 22, after “comprising” please insert --:--.

Claim 3, col. 9, line 36, please change “claim 2” to --claim 1--.

Claim 4, col. 9, line 39, please change “claim 2” to --claim 1--.

Claim 5, col. 9, line 41, please change “claim 2” to --claim 1--.

Claim 20, col. 10, line 66, please change “cf” to --of--.

Claim 25, col. 11, line 31, please delete the hyphen between “magazine” and “mount”.

Signed and Sealed this

Fifth Day of December, 2006

JON W. DUDAS
*Director of the United States Patent and Trademark Office*